US007257976B1

(12) United States Patent
Fabris

(10) Patent No.: US 7,257,976 B1
(45) Date of Patent: Aug. 21, 2007

(54) SPIRAL COOLING OF STEEL WORKPIECE IN A ROLLING PROCESS

(76) Inventor: Mario Fabris, 184 North Service Road, Grimsby, ON (CA) L3M 4E8

( * ) Notice: Subject to any disclaimer, the term of this patent is extended or adjusted under 35 U.S.C. 154(b) by 0 days.

(21) Appl. No.: 11/651,476

(22) Filed: Jan. 10, 2007

(51) Int. Cl.
*B21B 27/06* (2006.01)

(52) U.S. Cl. ..... 72/201; 72/342.2; 226/113

(58) Field of Classification Search ..... 72/200, 72/201, 342.2; 266/46, 113; 134/122 R, 134/64 R
See application file for complete search history.

(56) References Cited

U.S. PATENT DOCUMENTS 3,687,145 A * 8/1972 Schrader et al. ..... 134/114
3,945,623 A * 3/1976 Gaudilliere et al. ..... 266/112
4,197,730 A * 4/1980 Paulitsch ..... 72/201
4,210,010 A * 7/1980 Vlad et al. ..... 72/201
4,444,556 A * 4/1984 Andersson ..... 435/85
4,507,949 A * 4/1985 Killilea ..... 72/201
4,527,408 A * 7/1985 Jalil ..... 72/201
4,909,267 A * 3/1990 Tamm et al. ..... 134/122 R
5,035,403 A * 7/1991 Noville et al. ..... 266/114

* cited by examiner

*Primary Examiner*—Dmitry Suhol
(74) *Attorney, Agent, or Firm*—Edward H. Oldham

(57) ABSTRACT

A hollow cooling box for a steel mill to be used to cool a hot steel work piece as it passes through the cooling box; the box having an interior plenum formed by the members forming the cooling box. The plenum is supplied with coolant under pressure, and the coolant is allowed to pass through curved wedge shaped slots in one of the members which faces the work piece as it passes through the cooling box. The wedge shaped slots are oriented so that the widest part of said slot is on the upstream side of the passage of the work piece.

6 Claims, 2 Drawing Sheets

SPIRAL COOLING OF STEEL WORKPIECE IN A ROLLING PROCESS

FIELD OF THE INVENTION

It is well known that the temperature of a steel workpiece increases during a reduction process in a rolling mill. The work done on a steel workpiece causes the temperature of the steel workpiece to increase and thus the workpiece must be cooled by some external heat absorption material such as water in order to improve the rolling process and allow the mill to operate in a continuous manner.

Steel is a metal alloy composed of iron and carbon. This complex substance exists in many forms giving rise to Austenite, Perlite, Cementite, Banilte or Martinsite to mention a few of the forms in which this substance exists. All the above steels are formed by subjecting the hot steel product to various rates of cooling. Thus the cooling of a steel product is important during a rolling process. If the hot work product is cooled too quickly in local areas, the steel to which the excessive cooling has been subjected, may exhibit characteristics which are undesirable in the execution of a continuous rolling reduction process. It is to avoid such situations that this application is directed.

BACKGROUND OF THE INVENTION

In any steel mill where a steel workpiece is reduced from a bloom, bar or wire, the hot workpiece increases in temperature as the rolling reduction process continues. Steel mill operators have recognized this phenomenon and have sprayed the hot work product with cold water between the roll reduction stands to reduce its temperature and thus enable the rolling process to continue. The problem with this method of cooling is that as the hot steel rod passes through the cooling medium (usually water) some areas of the hot steel rod are cooled more quickly than others, giving rise to a product which exhibits a phenomenon known as "striping" where there appears on the surface of the steel workpiece areas of darkened stripes interspaced with stripes exhibiting hotter temperatures. These stripes appear along the length of the workpiece and cause problems when the workpiece is subjected to subsequent rolling operations and may lead to the production of a scrap steel product. In this instance the work product has become a steel alloy with varying physical characteristics (such as non-uniform hardness) and is difficult to roll in order to obtain uniform product characteristics.

SUMMARY OF THE INVENTION

The invention embodied in this application is the use of interstand cooling in a reducing steel mill which uniformly cools the hot steel product yielding a steel bar or rod which has a uniform grain structure and which may be subjected to a continuous rolling process which maintains the required physical characteristics in order to enable the operator to successfully market the end product.

The cooling system which is the subject of this invention generally uses water as the cooling medium and it is applied to the hot steel product. The coolant passes through the cooling device and exits in a spiral fashion around the hot work product. The cooling medium is directed through the device so as to impinge on the entire surface of the hot steel product during passage of the hot steel product between reducing stages of a rolling mill.

The cooling medium is directed to impinge on the hot steel product through a number of specially shaped orifices which tend to be curved so as to surround the hot moving work product and the curved slots are varied in width so as to apply a tapering supply of coolant to the steel rod as it passes therethrough. The supply of coolant will be greatest at the upstream position of the work product and diminishing in the direction of travel through the cooling device.

The cooling device itself encircles the hot steel work product so that the application of the coolant to the hot steel product is applied evenly and constantly from all sides to the hot steel product as it passes therethrough.

DESCRIPTION OF THE PREFERRED EMBODIMENT

Figure 1:
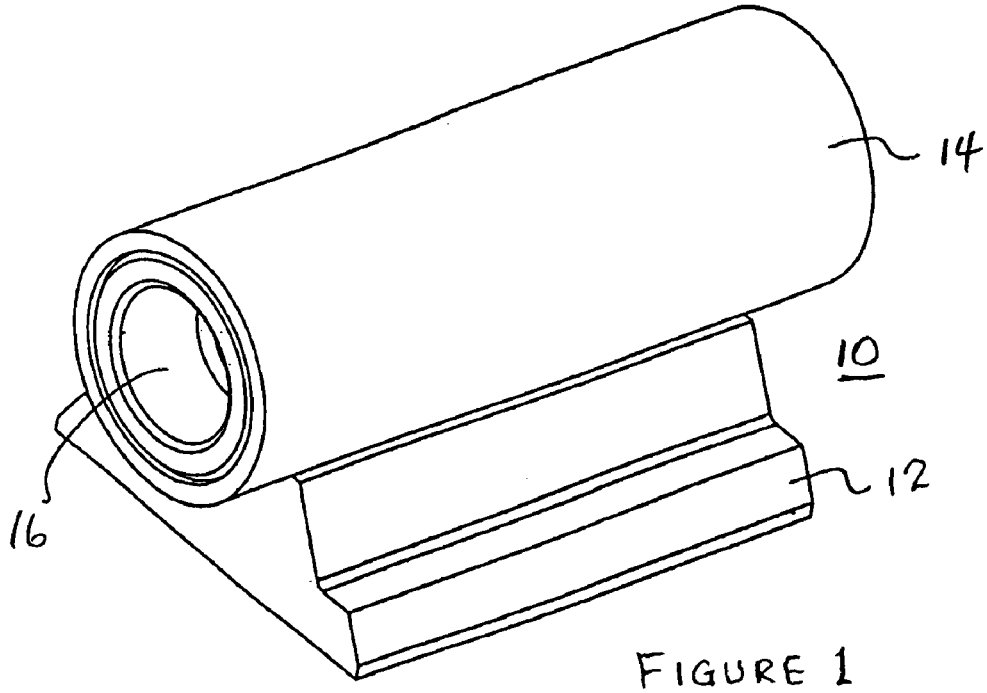
FIG. 1 is a perspective of the cooling device of this invention.

Referring now to FIG. 1, a perspective view of the cooling device 10 of this invention is shown. Here device 10 is shown having a base 12 which will be of such shape as to be suitable for clamping device 10 to a pre-existing frame work where several of the devices 10 may be serially mounted in order to cool a hot steel rod or bar undergoing reduction. Device 10 also has a cylindrically shaped portion 14 which is hollow to allow the passage of a hot steel work product to pass therethrough.

FIG. 1 shows device 10 having a tapered entrance aperture 16 to assist the hot steel product to easily enter device 10.

Figure 2:
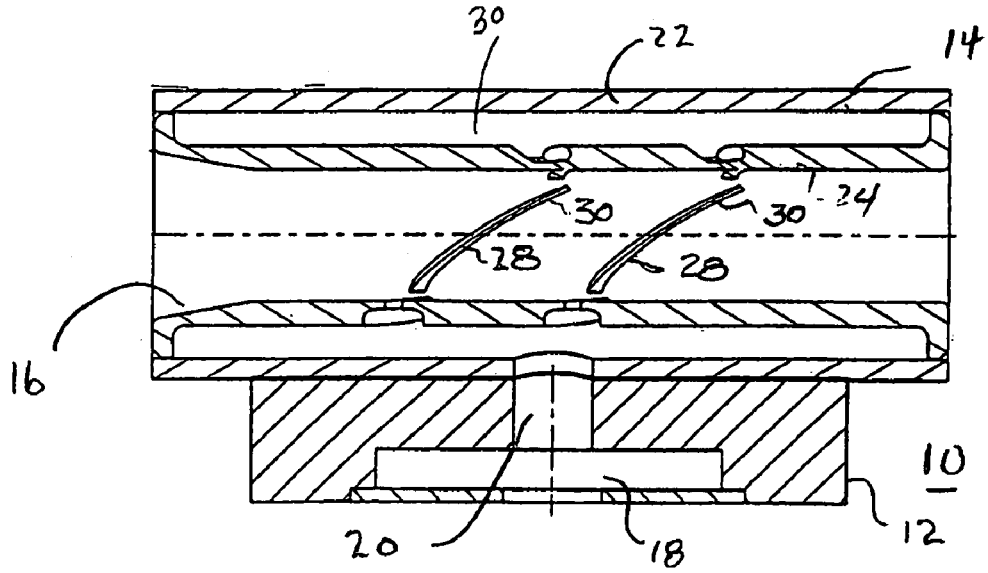
FIG. 2 is a section of the device of FIG. 1 showing the coolant orifices.

Referring to FIG. 2, it will be seen that device 10 is shown in section. It will be seen that the base 12 contains an opening 18 to permit a coolant (such as water) to enter the device 10. The coolant is ducted through duct 20 into cylindrical chamber 14 which itself comprises a pair of hollow shells suitably secured together to form a sealed structure.

Basically chamber 14 comprises cylinder 22 and concentrically located chamber 24 mounted therein. Chamber 24 which is the general shape of a hollow cylinder includes a tapered opening 16 to ease the entrance of the hot steel work product therein. Basically the cylinders 22 and cylinder 24 form a plenum 26 between them.

It will be seen that hollow cylinder 24 is provided with peculiarly shaped openings 28 which pass completely through the cylinder 24.

The shape of openings 28 is important; the forward facing portions of openings 28 are substantially larger than the trailing portions 30. The openings 28 extend completely around the surface of cylinder 24 so as to cause the coolant being pumped into duct 20 to evenly impinge on the hot work product. It is important that the whole surface of the work product passing therethrough be exposed to the coolant impinging thereon.

The volume of coolant impinging on the surface of the hot work product is largest at the beginning of the passage of the work product therethrough; the stream of coolant steadily diminishes as the work product passes therethrough. It is not known exactly how the cooling device produces a superior product, but it does. The compound known as steel is the result of material that reflects its history. If quenched from a high temperature to a lower temperature at a swift rate the carbon component appears as a particular grain structure in the steel compound.

If the cooling process is slower the grain structure of the steel product is completely different. Thus the shape of the coolant aperture in cylinder 24 will thus alter the grain structure of the steel product being produced in the mill.

It is also necessary to deliver a cooled steel product to the next rolling stage which is dry, thus it is necessary to air purge the hot steel work product at the conclusion of the passage through the cooling device 10 of this invention.

Figure 3:
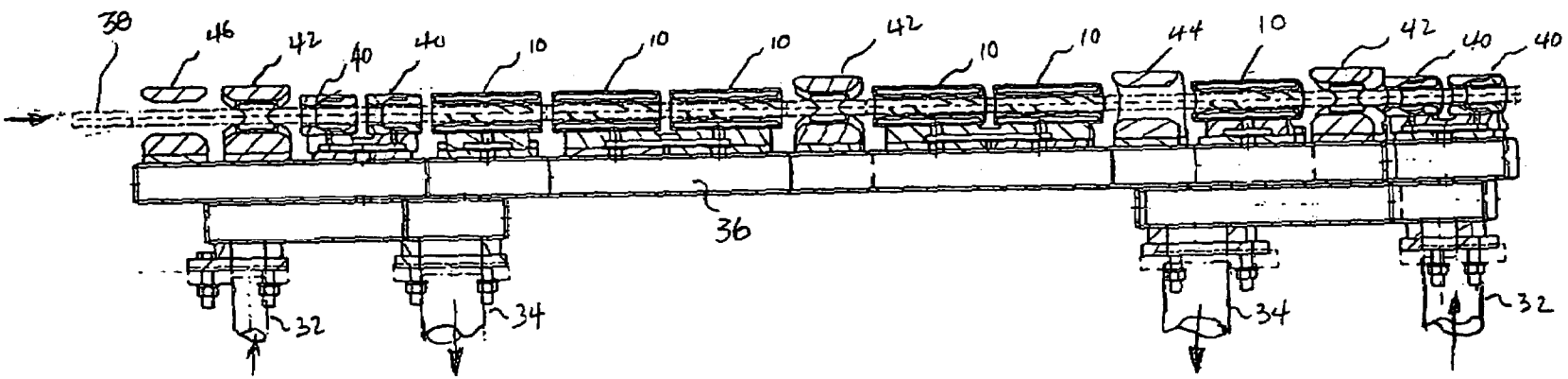
FIG. 3 is a typical installation of the cooling device shown in FIG. 1.

FIG. 3 shows a typical mill set up for the cooling system of this invention. Coolant conduits 32 and 34 are provided for ducting the coolant into and out of the system. Reference numeral 36 shows a distribution duct for the coolant. Here a hot steel rod 38 (shown in phantom) is shown entering guide at 46. After passage through guide 46, the hot work product enters roller guide 42. The workpiece next enters a pair of stripper devices 40 which remove any foreign debris from the surface of the hot steel work product 38 before the hot work product 38 enters the cooling devices 10. This prevents any problems which might arise due to clogging of coolant orifices in the devices 10. The process is again repeated after passage of the workpiece through devices 10 and air purge devices 40.

It will be seen that the coolant is applied to the hot work product (in this instance) at six individual stages between a pair of mill stands in this operation.

Because the work product is steel, there will be an ever-present problem with mill scale. Such scale must not be allowed to block any of the passages 28 of the cooling device 10. Steps are taken to remove the scale before the workpiece is passed through devices 10.

This invention is very important to the steel making industry. The cooling devices 10 of this invention tend to be much shorter in length than the cooling devices of the prior art.

It is not known for sure, but there appears to be an abundance of steam produced in the devices of the prior art and the cooling qualities of steam are much less than those of water. In this invention the work product is subjected to cooling by exposure to a plurality of cooling devices wherein each cooling device sprays the entire surface of the work product with water before it has had a chance to vaporize. The spiral shape of the orifices supplying water to the surface of the hot workpiece cannot be overemphasized.

It must be remembered that the internal shape of the cooling devices 10 must be matched to the shape and size of the hot work product passing therethrough. For instance, if a bar of a hexagonal cross section is being produced, the work passageway existing in devices 10 will of necessity be of a hexagonal cross section as well. Suitable clearances between the work passageway and the work product must be maintained.

Many modifications and other embodiments of the invention will come to the mind of one skilled in the art having benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

What is claimed:

1. A cooling box for cooling a steel work piece as it passes between reduction stages of a steel mill comprising:

a base of a shape to permit clamping to a stationary mounting stand, a hollow cooling tube being secured to said base for passage of a steel work piece therethrough, said hollow cooling tube having a cylindraceous plenum formed therein, said plenum having a series of curved wedge shaped slots formed therein to permit the passage of a coolant medium to pass therethrough and impinge on said work piece.

2. A cooling box as claimed in claim 1 wherein said base has a conduit for communication of said plenum with a source of coolant under pressure.

3. A cooling box as claimed in claim 1 wherein said work piece and said hollow tube are round.

4. A cooling box as claimed in claim 1 wherein said work piece is not round.

5. A cooling device for cooling a hot steel work piece comprising:

a hollow elongated body having an entrance aperture and passageway to such size as to accommodate the passage of a hot steel work piece therethrough, said body being comprised of two members, an exterior member and an interior member integrally secured together so as to form a sealed plenum between said members, said interior member having curved wedge shaped coolant slots formed therein to allow coolant to pass through and impinge on said work piece, said slots being so located so that the widest part of each wedge shaped coolant slot is adjacent said entrance aperture and, a conduit connecting said plenum to a source of coolant.

6. A method of cooling a hot steel work piece as it passes between rolling stands of a steel mill comprising:

passing said hot steel work piece through an enclosure which allows coolant to escape and impinge on said hot work piece as it passes therethrough, said enclosure having a series of wedge shaped curved slots to allow the coolant to escape therethrough, said slots having the greatest width on the upstream side of said enclosure.

* * * * *